US005331776A

United States Patent [19]

Shelton et al.

[11] Patent Number: 5,331,776

[45] Date of Patent: Jul. 26, 1994

[54] ROOFING ABUTMENT APPARATUS

[76] Inventors: Brett M. Shelton; Michael L. Meyer, both of 1427 Phoenix Dr., #5, Fairfield, Calif. 94533

[21] Appl. No.: 31,263

[22] Filed: Mar. 15, 1993

[51] Int. Cl.[5] ..... E04G 3/08

[52] U.S. Cl. ..... 52/24; 52/127.1; 182/45; 248/237

[58] Field of Search ..... 52/24, 25, 26, 173.1, 52/127.2, 127.1; 248/237; 182/45

[56] References Cited

U.S. PATENT DOCUMENTS 369,257 8/1887 Martz ..... 52/25
675,625 6/1901 Ewing ..... 248/237
939,516 11/1909 Laird ..... 52/25

FOREIGN PATENT DOCUMENTS 45728 11/1928 Norway ..... 52/26

*Primary Examiner*—Michael Safavi
*Attorney, Agent, or Firm*—E. Michael Combs

[57] ABSTRACT

The apparatus is arranged to include an individual or a plurality of abutment members, having first plates mounting at their first ends a second plate for engagement of a roof edge or tile edge portion, wherein a second end of the first plate mounts an abutment plate extending orthogonally and laterally of the first plate in an orthogonal relationship to a reverse side relative to the first plate. A support plank is arranged for positioning to an adjacent of the abutment members to provide for abutment of debris that may be directed along the roof surface.

1 Claim, 4 Drawing Sheets

ROOFING ABUTMENT APPARATUS

BACKGROUND OF THE INVENTION

1. Field of the Invention

The field of the invention relates to roofing apparatus, and more particularly pertains to a new and improved roofing abutment apparatus wherein the same is arranged to provide for abutment to prevent debris from falling from a roof surface during a roofing procedure.

2. Description of the Prior Art

Roofing apparatus of various types have been utilized throughout the prior art such as a platform structure, as indicated in U.S. Pat. Nos. 4,450,935 and 5,004,072.

The instant invention is arranged to overcome deficiencies of the prior art by providing for abutment apparatus arranged to include a plurality of engaging abutment members to prevent debris from falling from a roof surface during a roofing procedure and in this respect, the present invention substantially fulfills this need.

SUMMARY OF THE INVENTION

In view of the foregoing disadvantages inherent in the known types of roofing apparatus now present in the prior art, the present invention provides a roofing abutment apparatus wherein the same is arranged for securement to a roof surface to engage the roof or tile portion of the roof preventing debris from falling from a roof surface. As such, the general purpose of the present invention, which will be described subsequently in greater detail, is to provide a new and improved roofing abutment apparatus which has all the advantages of the prior art roofing apparatus and none of the disadvantages.

To attain this, the present invention provides an apparatus arranged to include an individual or plurality of abutment members, having first plates mounting at their first ends a second plate for engagement of a roof edge or tile edge portion, wherein a second end of the first plate mounts an abutment plate extending orthogonally and laterally of the first plate in an orthogonal relationship to a reverse side relative to the first plate. A support plank is arranged for positioning to an adjacent of the abutment members to provide for abutment of debris that may be directed along the roof surface.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved roofing abutment apparatus which has all the advantages of the prior art roofing apparatus and none of the disadvantages.

It is another object of the present invention to provide a new and improved roofing apparatus which may be easily and efficiently manufactured and marketed.

It is a further object of the present invention to provide a new and improved roofing apparatus which is of a durable and reliable construction.

An even further object of the present invention is to provide a new and improved roofing apparatus which is susceptible of a low cost of manufacture with regard to both materials and labor, and which accordingly is then susceptible of low prices of sale to the consuming public, thereby making such roofing apparatus economically available to the buying public.

Still yet another object of the present invention is to provide a new and improved roofing apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
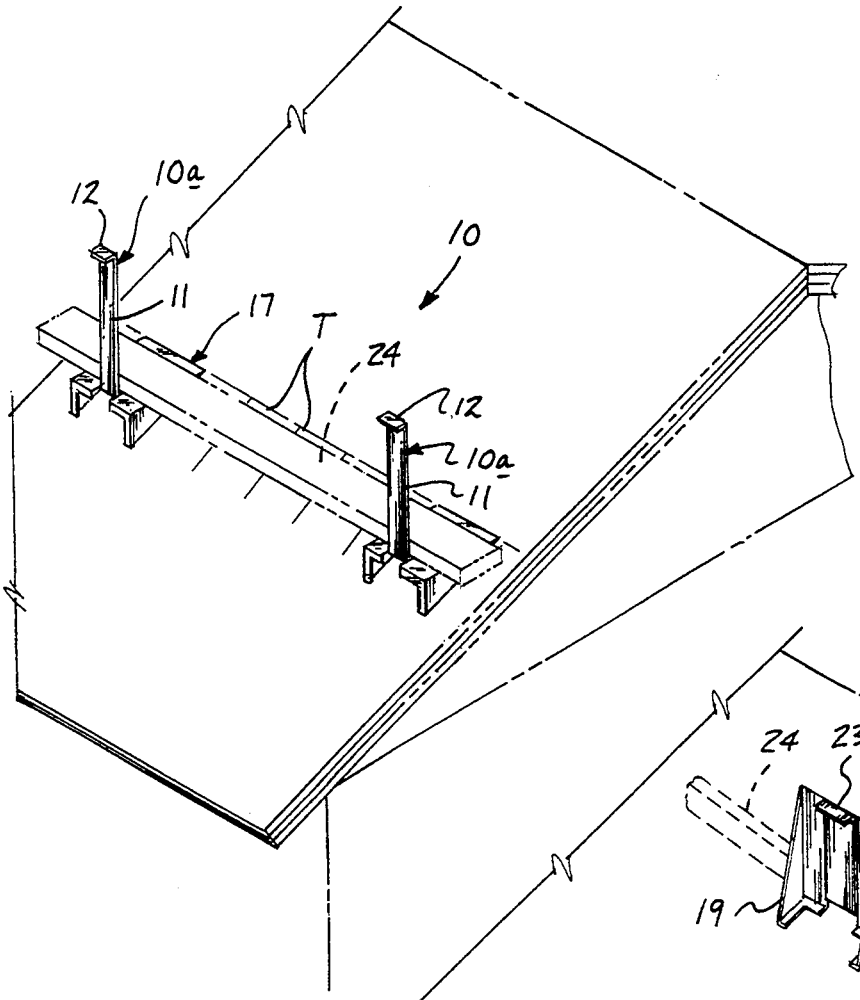
FIG. 1 is an isometric illustration of the invention is use.

With reference now to the drawings, and in particular to FIGS. 1 to 8 thereof, a new and improved roofing abutment apparatus embodying the principles and concepts of the present invention and generally designated by the reference numeral 10 will be described.

Figure 2:
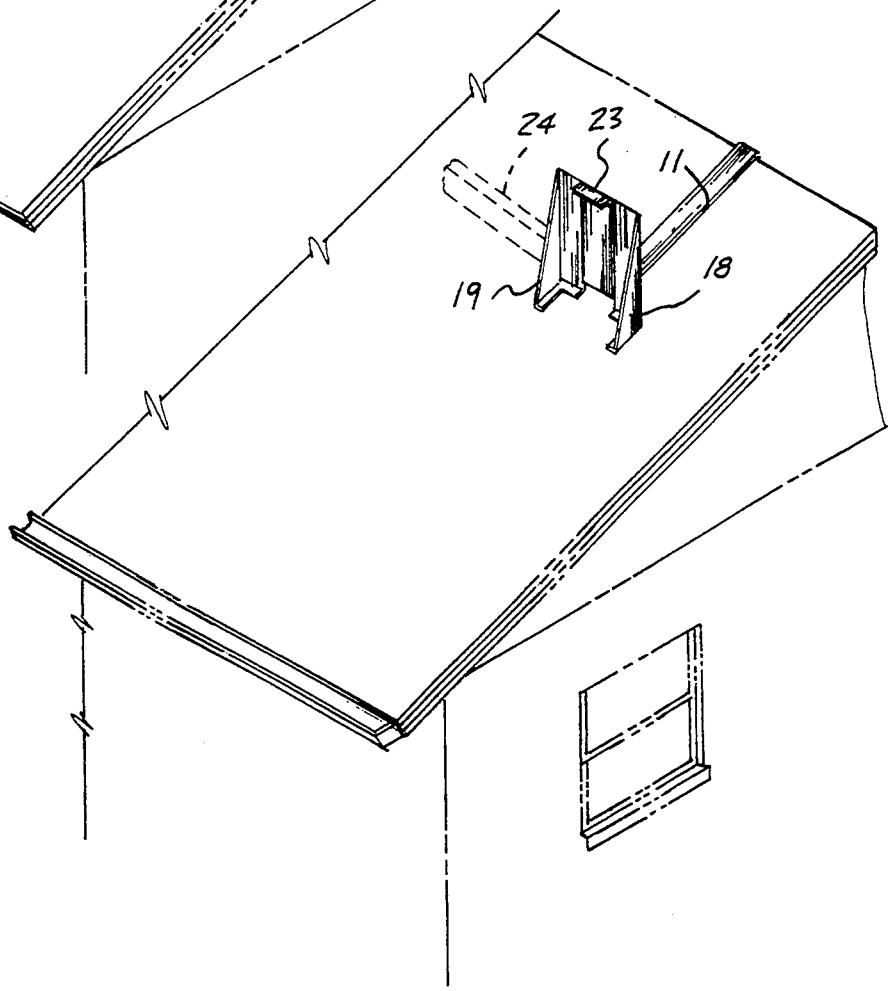
FIG. 2 is an isometric illustration of the invention employing the organization arranged in a varying manner of engaging a roof surface.
Figure 3:
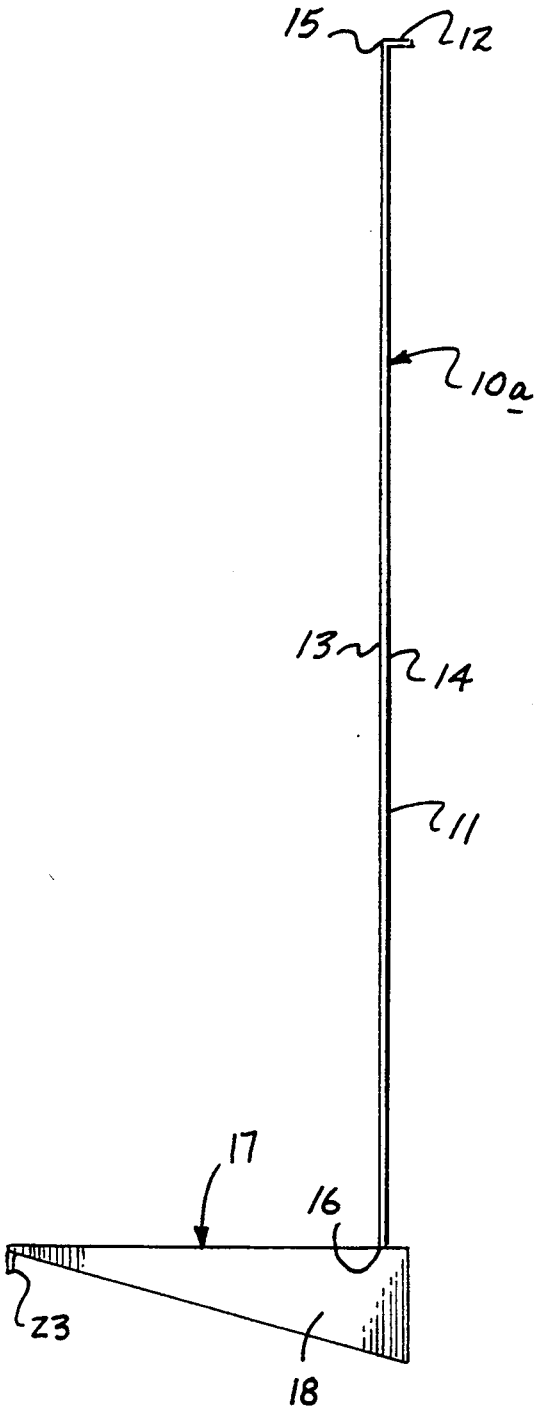
FIG. 3 is an orthographic side view of the invention.
Figure 4:
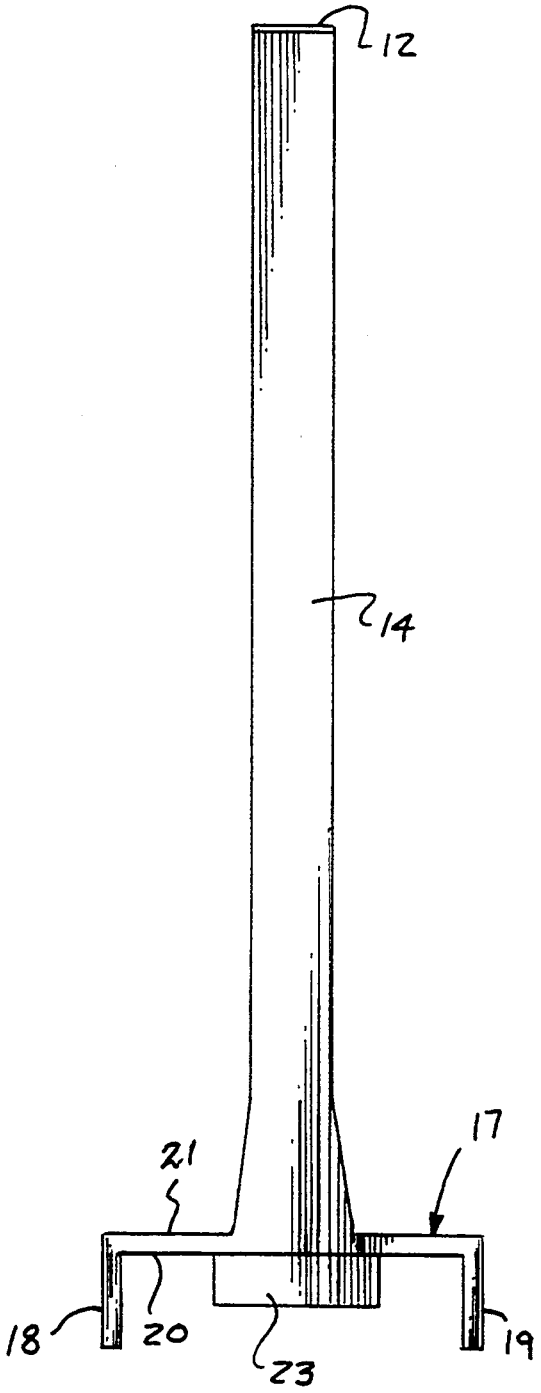
FIG. 4 is an orthographic end view of the invention.
Figure 5:
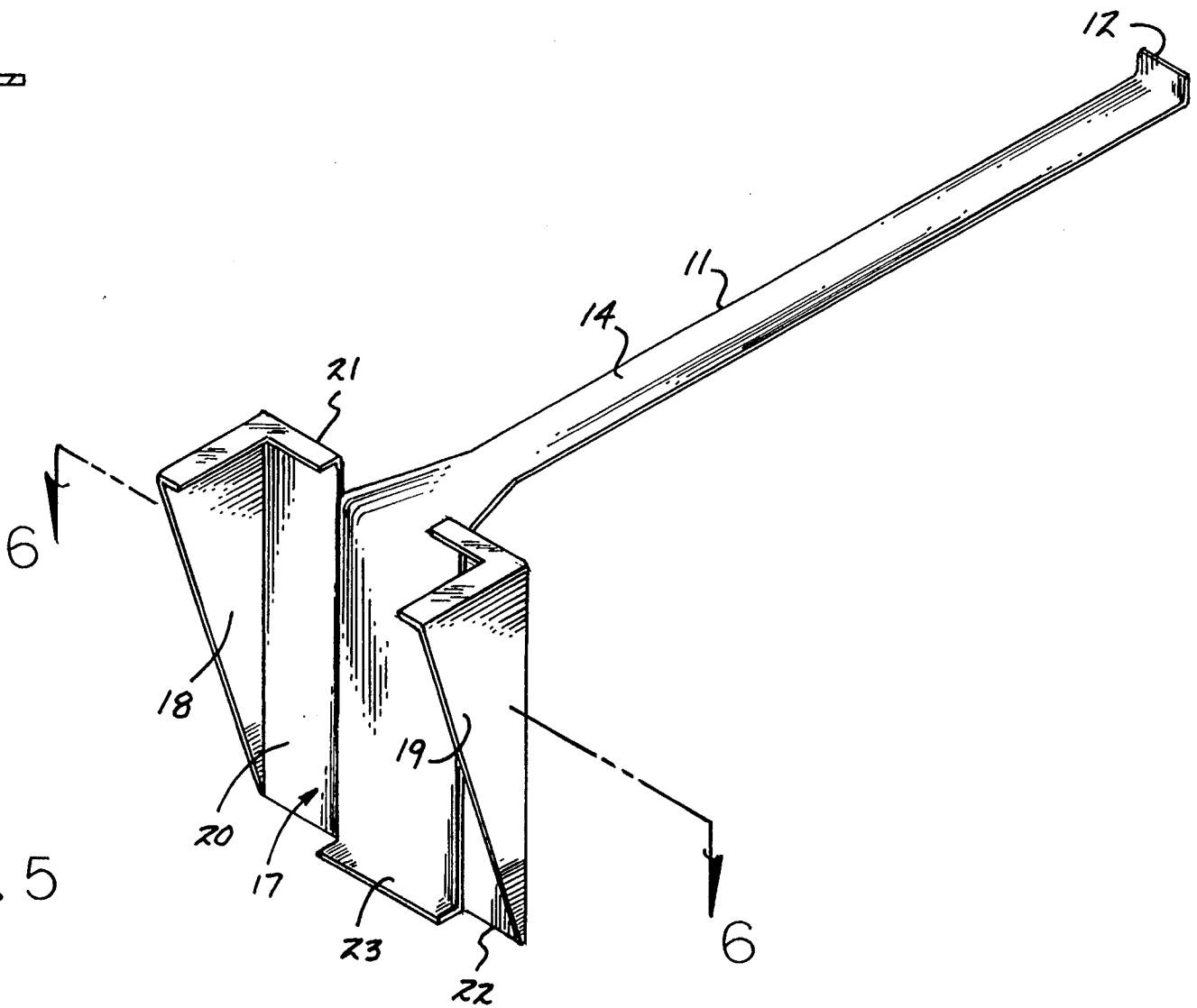
FIG. 5 is an isometric illustration of the invention.
Figure 6:
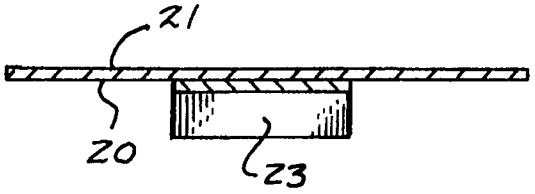
FIG. 6 is an orthographic view, taken along the lines 6—6 of FIG. 5 in the direction indicated by the arrows.

More specifically, the roofing abutment apparatus 10 of the instant invention essentially comprises a plurality of abutment members 10*a*, as indicated in FIG. 1, arranged for gripping individual roofing tiles "T". Further, the structure may be employed to include the grasping of a roof edge, as indicated in FIG. 2, by an individual or the abutment members 10*a* in adjacency relative to one another. The abutment members 11 are each of identical construction and for purposes of illustration and description, only one such abutment member 10*a* will be described. To this end, a first plate 11 of a first length includes a first plate first side 13 parallel to and coextensive with a first plate second side 14. A first plate first end 15 orthogonally mounts a second plate 12 thereto in an orthogonal relationship relative to the first plate 11 extending from the first plate second side, as indicated in FIGS. 3 and 4 for example. The first plate second end 16 mounts an abutment plate 17 orthogonally relative to the first plate extending orthogonally relative to the first plate first side, and having respective first and second triangular positioning plates 18 and 19 that are parallel and coextensive relative to one another and orthogonally mounted to opposed sides of the abutment plate 17 extending from the abutment plate bottom surface 20. The abutment plate 17 includes an abutment plate forward edge 22 spaced from and parallel the first plate 11, with the abutment plate forward edge 22 having a forward edge plate 23 extending orthogonally relative to the abutment plate 17 at the forward edge 22 projecting beyond the abutment plate bottom surface 20, as indicated in the FIGS. 3 and 4 for example. As the forward edge plate 23 is oriented at the apex of each of the positioning plates 18 and 19, the forward edge plate 23 is arranged for engagement with a tile "T", as indicated in FIG. 1, as required. Accordingly, support plank 24 is arranged to span the spaced abutment members 10*a* along the abutment plate 17 of each abutment member 10*a*, wherein the abutment member 17 engages an associated tile "T", or the first plate 11 engages a tile or roof edge, as indicated in FIG. 2. In this manner, the abutment plate 17, as well as a plank 24, provides for an engaging surface to prevent debris from the roof from descending the roof and thereby preventing inadvertent injury and damage to underlying individuals or property relative to the roof surface during a roofing procedure.

Figure 7:
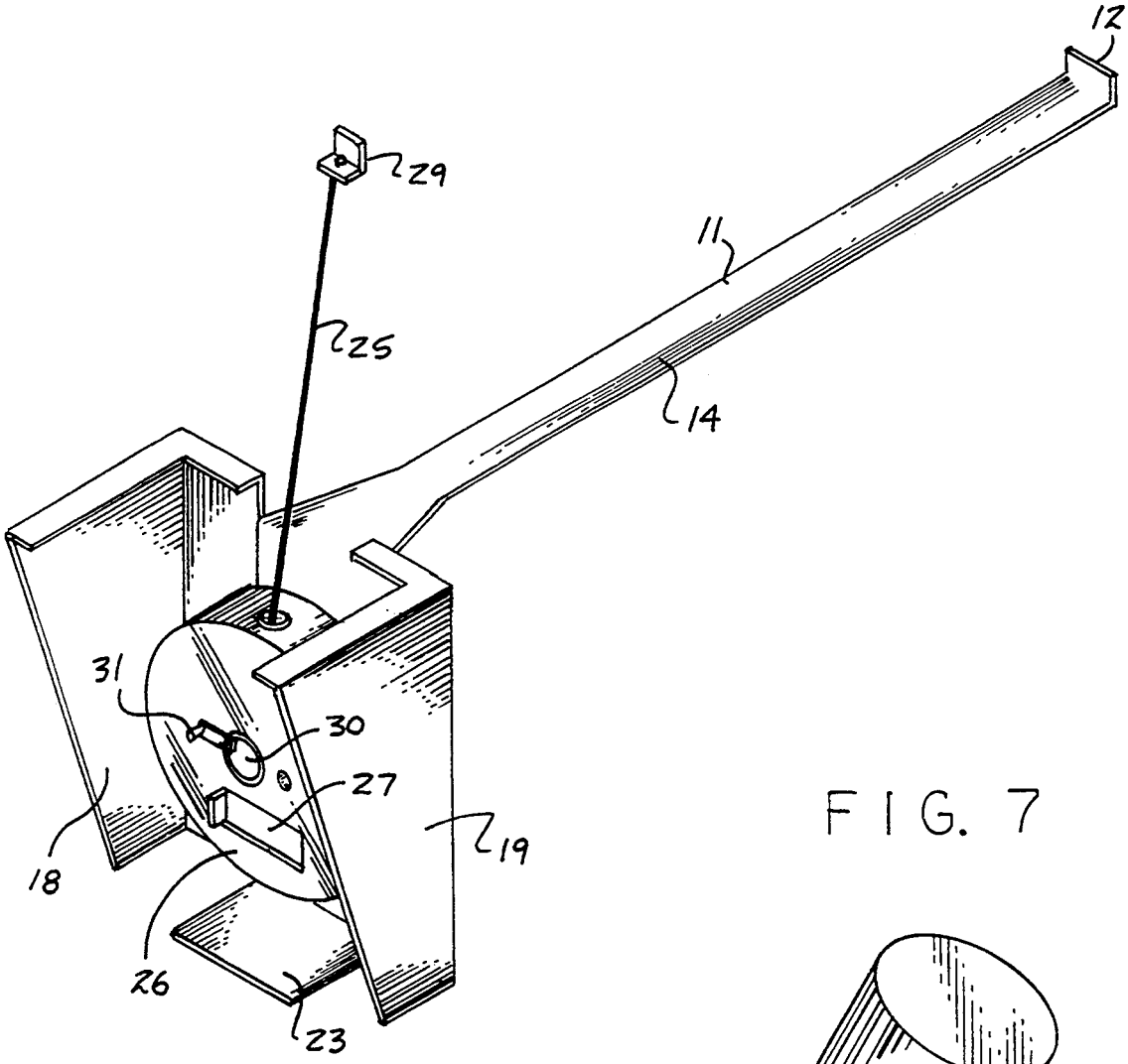
FIG. 7 is an isometric illustration of one of the abutment members mounting a chalk line structure therewithin.
Figure 8:
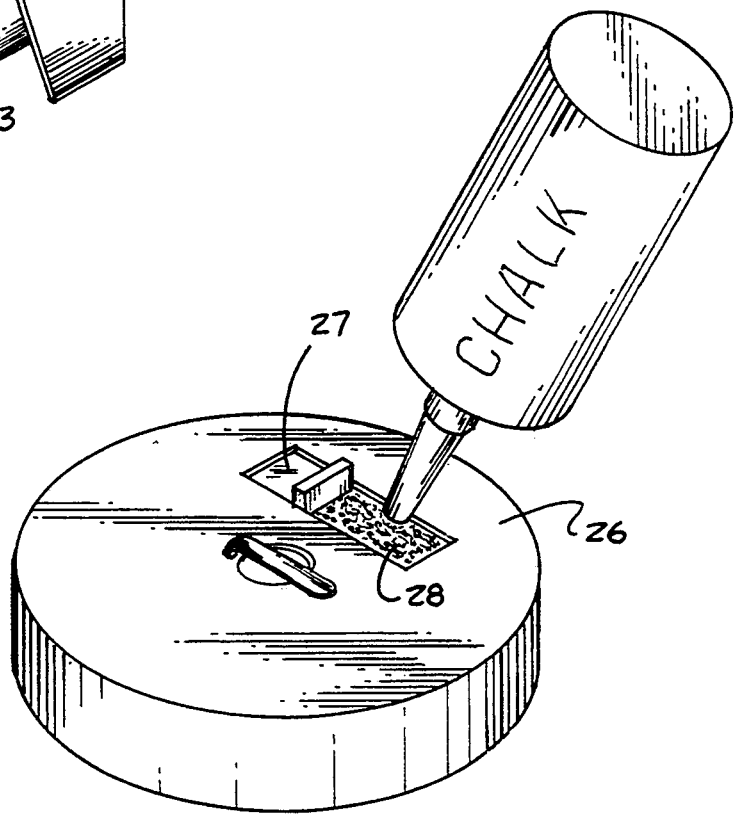
FIG. 8 is an enlarged isometric illustration of the chalk line housing structure of the invention mounted to the bottom surface of the abutment plate.

The FIGS. 7 and 8 indicates the use of a chalk line structure mounted to the abutment plate bottom surface 20, wherein a flexible chalk string 25 is rotatably wound within a housing 26 mounted fixedly to the bottom surface 20. A door plate 27 is directed into the housing for access within the housing cavity 28 for deposit of chalk powder, as indicated in FIG. 8, to thereby permit the chalk string 25 to be coated with such powder when directed through the housing side wall opening 32. The chalk string 25 has its free end secured to a chalk string lug 29 to prevent the chalk string from being directed within the housing through the side wall opening 32, with the chalk string housing end within the housing wound about a housing axle 30 that includes an axle handle 31 positioned exteriorly of the housing for winding the chalk string about the axle 30 within the housing 26. The chalk line structure permits an individual for optional use of the structure for aligning tiles in a row along the roof surface and for subsequent positioning of the abutment members 10*a*, in a manner as indicated in FIGS. 1 and 2.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A roofing abutment apparatus, comprising, at least one abutment member arranged for positioning upon a roof surface, wherein the abutment member includes a first plate having a first length, the first plate including a first plate first side spaced from and parallel a first plate second side, a first plate first end spaced from a first plate second end, and a second plate, and the first plate having a first length, with the second plate having a second length less than the first length, with the second plate fixedly and orthogonally mounted to the first plate first end and projecting from the first plate second side, with an abutment plate fixedly and orthogonally mounted to the first plate second end extending from the first plate first end, with the abutment plate including an abutment plate top surface and an abutment plate bottom surface orthogonally oriented relative to the first plate first side, and the abutment plate including an abutment plate forward edge spaced from and parallel the first plate, with the forward edge including a forward edge plate orthogonally mounted to the forward edge projecting beyond the abutment plate bottom surface, with the forward edge plate and the second plate arranged for engagement of a roof tile, and a first triangular positioning plate and a second triangular positioning plate arranged in a parallel coextensive relationship relative to one another and orthogonally mounted to opposed sides of the abutment plate projecting beyond the abutment plate bottom surface for affording stability to the abutment plate in its orientation relative to the roof tile, and a further abutment member of identical construction to said at least one abutment member, and a rigid support plate extending between the further abutment member and said at least one abutment member, and engaging the abutment plate and the first plate, and at least one abutment member includes a string housing mounted to the abutment plate bottom surface between the first positioning plate and the second positioning plate, with the string housing having a housing cavity and a door plate directed through the housing for access to the housing cavity for positioning powdered chalk within the housing cavity, and a flexible chalk string, with a housing axle rotatably mounted within the housing, and the chalk string wound about the housing axle, and the chalk string including a free end positioned exteriorly of the housing, with the housing having a side wall opening, and the chalk string directed through the side wall opening, and the chalk string free end having a chalk string lug preventing directing of the chalk string free end within the housing, and the axle including an axle handle positioned exteriorly of the housing permitting manual rotation of the axle and winding of the string about the axle.

* * * * *